US005478275A

United States Patent [19]

Malm

[11] Patent Number: 5,478,275

[45] Date of Patent: Dec. 26, 1995

[54] RADIAL FAN

[75] Inventor: Lars Malm, Sölvesborg, Sweden

[73] Assignee: AB Volvo, Sweden

[21] Appl. No.: 170,331

[22] PCT Filed: Jun. 17, 1992

[86] PCT No.: PCT/SE92/00435

§ 371 Date: Mar. 7, 1994

§ 102(e) Date: Mar. 7, 1994

[87] PCT Pub. No.: WO93/01414

PCT Pub. Date: Jan. 21, 1993

[30] Foreign Application Priority Data

Jul. 5, 1991 [SE] Sweden ..... 9102098

[51] Int. Cl.[6] ..... B60H 1/26

[52] U.S. Cl. ..... 454/139; 415/95; 415/102; 415/131; 415/150; 415/157; 416/178; 416/184; 416/186 A; 416/187

[58] Field of Search ..... 415/94, 95, 101, 415/102, 131, 148, 150, 157, 158; 416/184, 186 A, 187, 178; 454/139

[56] References Cited

U.S. PATENT DOCUMENTS

| | | | |
|---|---|---|---|
| 2,537,805 | 1/1951 | Wilken | 416/187 |
| 2,542,121 | 2/1951 | Earl | 415/157 |
| 2,714,485 | 8/1955 | Goettl | 416/187 |
| 4,244,685 | 1/1981 | Lahtinen | 415/157 |
| 4,779,672 | 10/1988 | Seikou et al. | 454/139 |
| 4,808,068 | 2/1989 | Asbjornson et al. | 415/157 |
| 5,207,557 | 5/1993 | Smiley, III et al. | 415/157 |

FOREIGN PATENT DOCUMENTS

| | | | |
|---|---|---|---|
| 0324492 | 11/1957 | Germany | 415/157 |
| 488940 | 5/1970 | Switzerland . | |
| 1339690 | 12/1973 | United Kingdom . | |

*Primary Examiner*—Edward K. Look
*Assistant Examiner*—Christopher Verdier
*Attorney, Agent, or Firm*—Lerner, David, Littenberg, Krumholz & Mentlik

[57] ABSTRACT

A ventilation system for a car including an outside air channel, an interior air channel, and a radial fan having a suction side and an exhaust side. The fan is situated at junction between the outside air and interior air channels, so that the outside air and interior air channels are axially connected to the suction side of the fan. A partition wall is movable within an unrestricted cavity, so that the outside air and interior air channels are situated at different sides thereof.

11 Claims, 4 Drawing Sheets

RADIAL FAN

TECHNICAL FIELD

The present invention relates to a radial fan, especially a fan which is used in cars for suction of fresh air and possibly at the same time recirculation and mixing of air being present in the car. It can also be used for the choice of or mixing of gas streams in other connections, for example in the ventilation system in buildings.

PRIOR ART

In all cars manufactured during the later decades there is an input opening for fresh air and a fan in connection therewith. The input openings of fresh air can be of different constructions and they can be located at different places in the car but it is at present usual that they consist of a bar protected opening in the plate in front of the front wind screen. This opening can at some older models be closed by means of a shutter which is operated from the inside of the car, the shutter in the open position acting as an air scope for the air. It is however usual that the air intake can not be closed in this way and the air channels are usually closed further in the car by means of valves or the like.

When a car having a bar protected fresh air intake of said kind is moved forward at different speeds the air pressure against the bar protected opening will change in dependence of the speed of the car and as a consequence thereof the amount of fresh air flowing into the car. The air stream is therefore as said above controlled by means of valves. At low speeds however the air stream will be too small which is the reason why a fan for suction of fresh air is necessary in the air intake system. This fan is also necessary because a part of the air which already is in the car shall be recirculated and optionally heated together with the newly supplied fresh air.

The same circumstances can also be present at buildings where the ventilation system can be influenced by different wind speeds and wind directions.

Different types of fans and valves for this purpose are known earlier. They may be simple or very complicated but a common feature with all these is that the air streams are controlled by means of different valve arrangements. The fan arrangement can also be moveable to bring about certain streaming effects. See for instance the Japanese patent application 58-168906.

TECHNICAL PROBLEM

The above mentioned fresh air arrangements for example cars can in many ways be regarded satisfactory but they have all the disadvantage that they are sensible to the speed with which the vehicle is driven forward in that the air pressure against the air intake is changed so that the streaming conditions in the whole fresh air system is influenced. This has the consequence that one must move the valves to different positions depending on the speed with which one drives the vehicle. This can also lead to the circulating air streaming in wrong direction. The valves are usually controlled from the driver position by means of moveable handles or at some more sophisticated arrangements in electronic ways.

It has therefore always been a desire that in a simple and cheap way be able to control the amount of fresh air streaming in and to bring about the correct mixing ratio between this and the air circulating in the car or in a building independent of the speed of the car or the wind and in such a way that any flow in wrong direction will not occur.

The Solution:

According to the present invention one has been able to solve the problems connected with earlier known arrangements and satisfy the wishes according to the above by bringing about a radial fan for for example cars comprising radially arranged fan plates having an axial extension for axial suction and radial blowing of a medium such as air which radial fan is characterized by the shaft arranged axially moveable and adaptable radially directed partition wall which extends outwardly at least to the plates and suction openings at either side of the partition wall.

It is according to the invention further suitable that the partition wall is slidably mounted on a shaft in the shape of an axially slotted pipe and that it via a projection through the slot is connected to a threaded shaft within the pipe, a wire or spring for axial movement of the partition wall.

It is according to the invention suitable that the threaded shaft is rotatable by means of a position motor.

To facilitate the axial suction of the medium one can according to the invention let the spokes which at one of the axial ends carry the fan plates have a shape as an axial fan.

DESCRIPTION OF THE FIGURES

The invention will in the following be described more in detail in connection with the attached drawings, where FIG. 1 schematically shows a conventional air intake on a car comprising a radial fan, where

FIG. 2 shows the same conventional ventilation arrangement as the one according to FIG. 1. The difference is that the valve 5 in FIG. 2 has been opened more that what is the case in FIG. 1 with relation to the circulation air channel 4. This can in spite of the influence from the radial fan 6 result in that the outside air which comes in through the channel 1 and is intended to stream into the compartment via the channels 8 and 9 partly takes a way into the channel 4 against the intended air stream. If this occurs or not depends on the speed of the car and how much the valve 5 has been opened and the speed of the fan. In a case like this one, no circulation of the compartment air will of course occur, neither will any heating of it be brought about.

When ventilating buildings one has a similar problem. The ventilation is also there conducted by means of fans and valves and it is influenced in a similar way as at cars by changes of the strength and direction of the wind.

Figure 1:
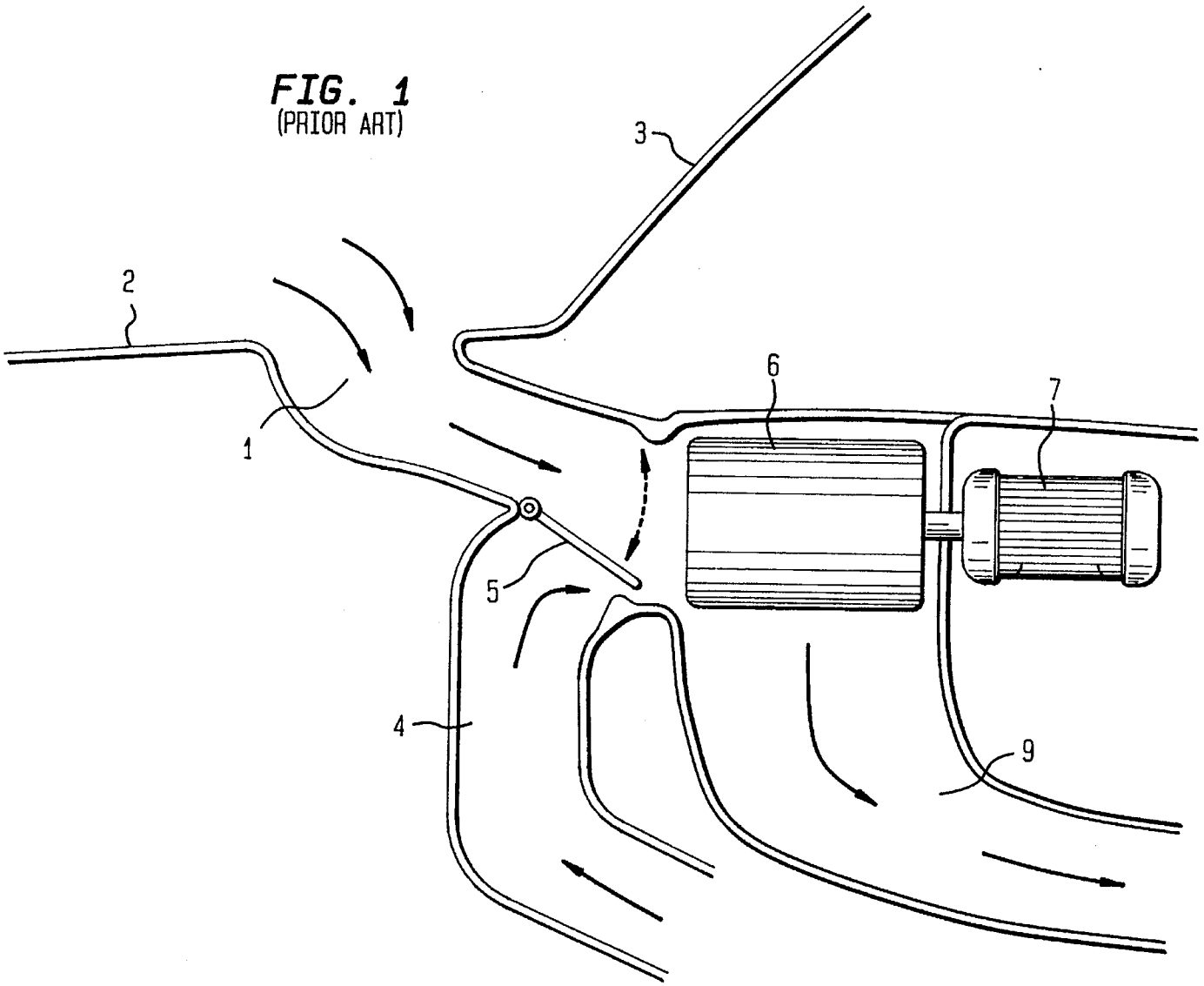
FIG. 1 (PRIOR ART)
FIG. 1 shows a fresh air channel 1 which is arranged at the end of the bonnet 2 and is positioned in front of the wind screen 3. A channel 4 adapted for circulation of the compartment air is provided at the inner end of the fresh air channel 1. At the connection between the channels 1 and 4 a valve 5 is arranged, which can control the mutual amount ratios between the air streams in the channels 1 and 4. Inside the valve there is a radial fan 6 which is driven by an electric motor 7. This radial fan blows the mixed air coming from the channels 1 and 4 into the compartment through the channel 9.
Figure 2:
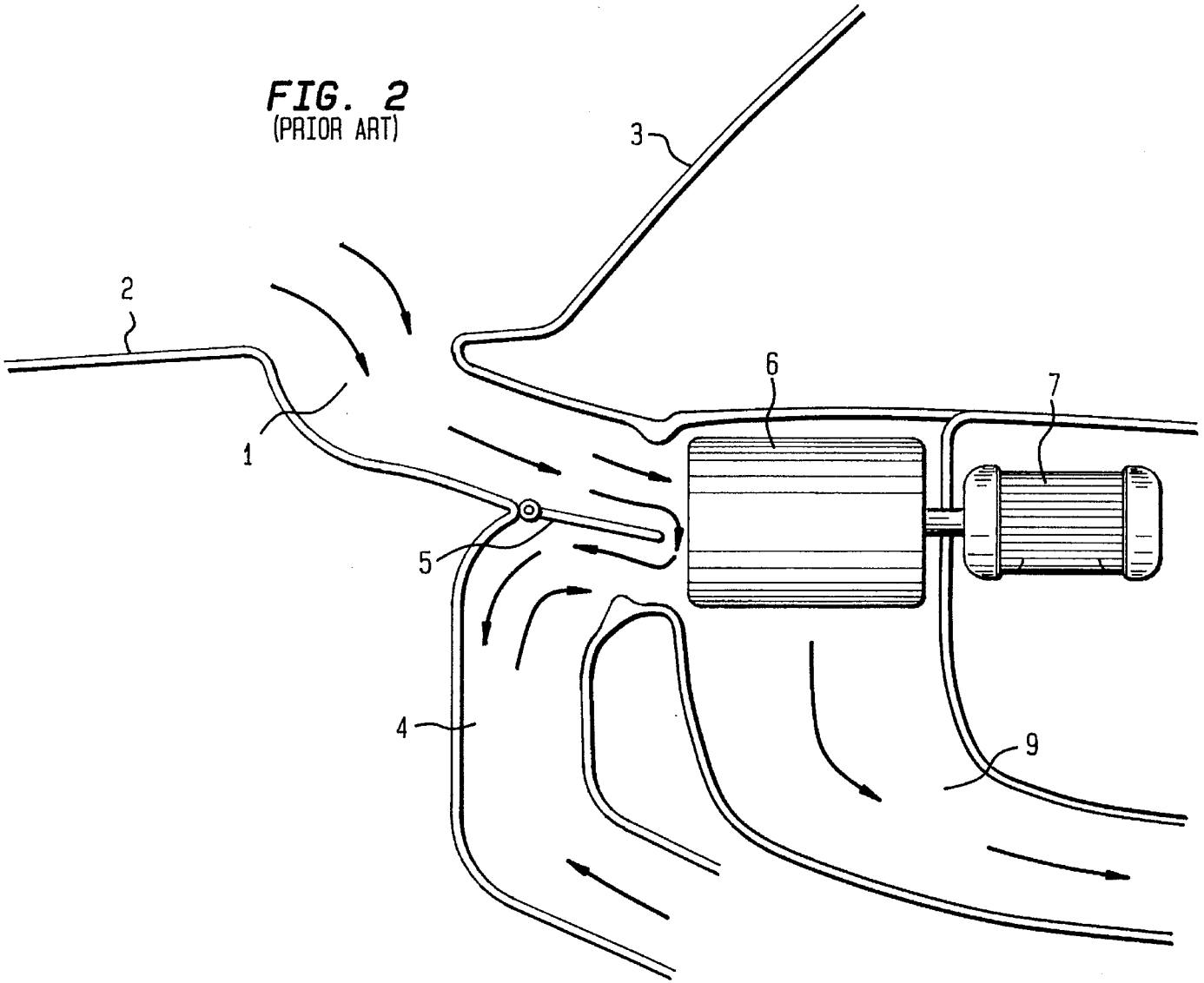
FIG. 2 (PRIOR ART)
FIG. 2 shows the same as in FIG. 1, but having the valve in another position, where
Figure 3:
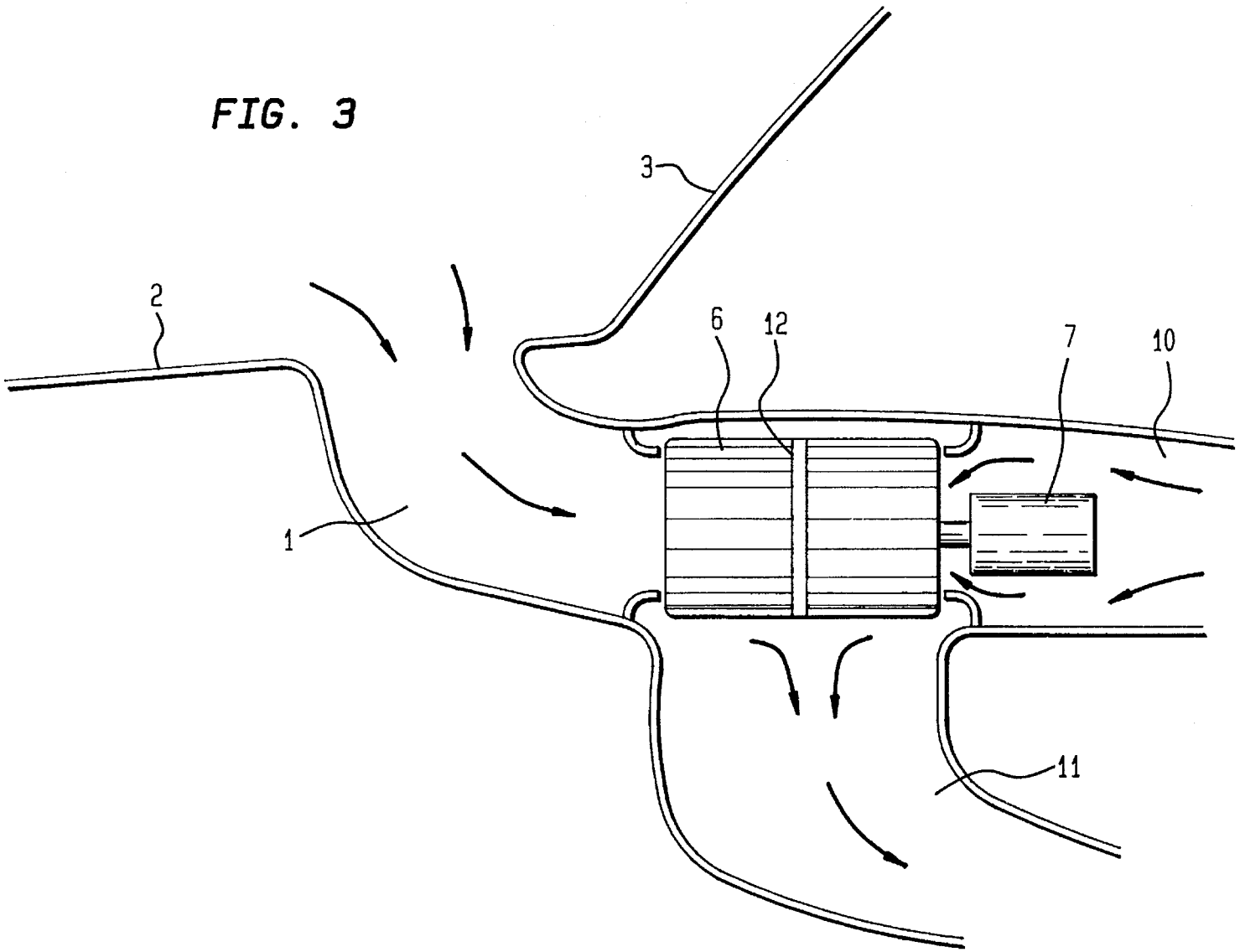
FIG. 3 shows an air intake having a radial fan according to the present invention, and FIG. 4 in section shows a radial fan according to the present invention.

FIG. 3 shows a fresh air arrangement comprising the radial fan according to the present invention. In this case the outside air is blown through the channel 1 directly against the radial fan 6 from the front side whereas the compartment air is sucked in against the radial fan from the other axial side through the channel 10. The combined air streams are blown thereafter via the channel 11 out into the compartment. The necessary and substantial partition wall 12 according to the invention for this arrangement is shown schematically on the radial fan 6.

PREFERRED EMBODIMENT

Figure 4:
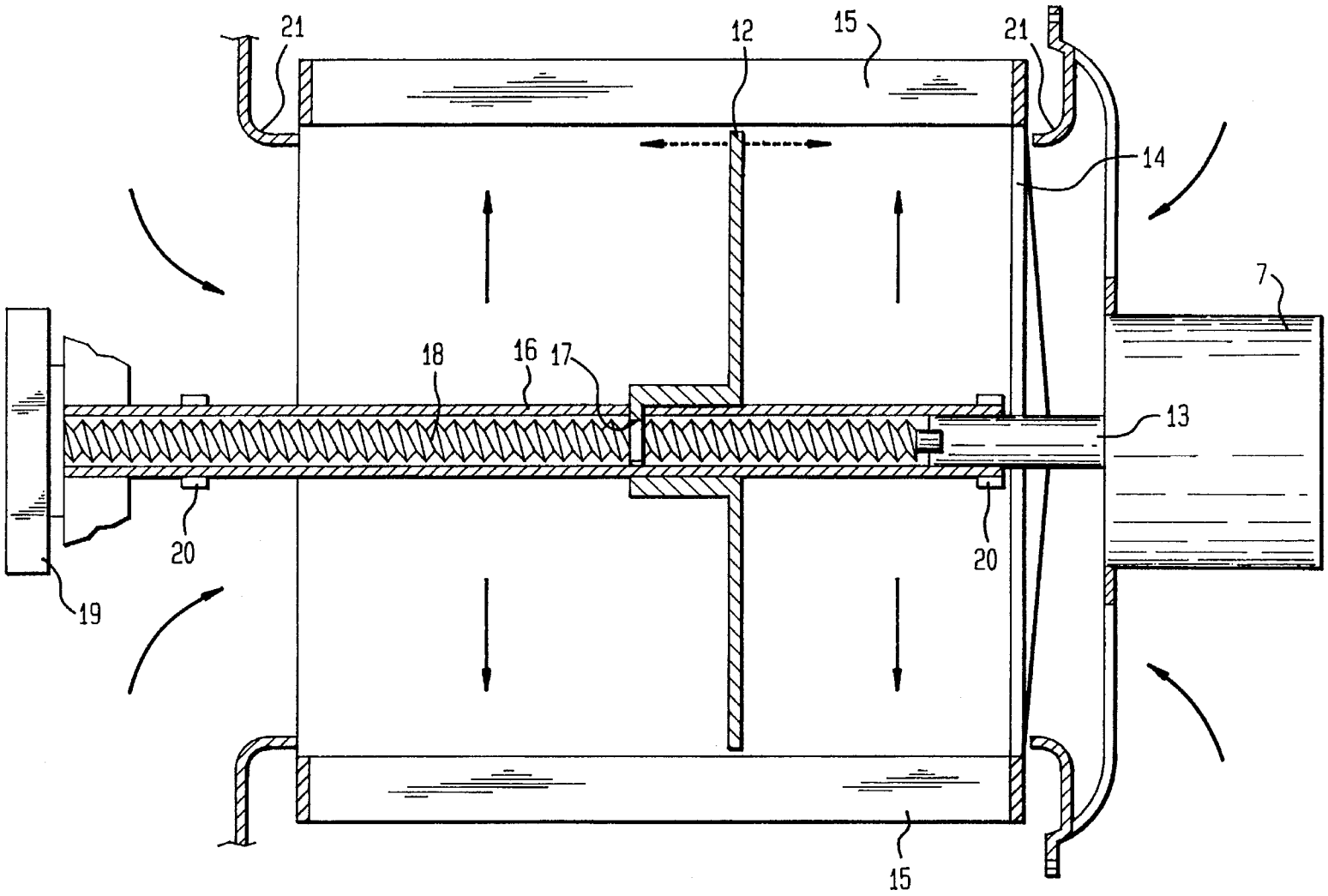

A preferred embodiment of the invention is shown in FIG. 4. The fan shown is driven by an electric motor 7 in a conventional way via a shaft 13 which by means of a frame or spokes 14 in a known way carry the fan plates 15. These are extending axially and extend also radially outwards. Within these plates 15 a cylindrical cavity exists in which the partition wall 12 has been arranged. The partition wall is slidably mounted on a pipe shaped shaft 16 which is provided with an axial slot. Through this slot a projection 17 extends from the partition wall 12 which protrusion 17 engages a threaded shaft 18. This threaded shaft 18 is mounted in the car body and can be rotated by means of a position motor 19. By means of this threaded shaft 18 the partition wall 12 can consequently be displaced to a desired axial position as the projection 17 is provided with inner threads which engage the threads on the shaft 18. Instead of the threaded shaft 18 an arrangement with wires and springs can be used. Stops 20 are arranged on the pipe shaped shaft 16 for limiting the displacement of the partition wall 12. When the motor 7 and the fan plates 15 are rotated air is sucked in from the open axial ends of the fan and forced out radially as the thick, not filled arrows show. It appears clearly that the ratio between air from one side and air from the other side can be regulated according to a desire by displacement of the wall 12. This wall 12 can also completely close the inlet from some end as it can be brought into contact with any of the seals 21.

The displacement of the wall 12 can be carried out by pushing a button in the drivers compartment or it can be moved automatically in that desired temperature or mixing ratio is put in a computer which via sensors also is informed of the pressure etc of the incoming air and thus automatically can place the wall 12 in a correct position.

The displacement of the wall 12 can of course be carried out in another way than by the arrangement shown. It can be pulled or pushed or guided by guiding elements in the disc in the periphery of the partition wall or at some other place. It is also possible that the fan plates 15 extend longer radially which means that the partition wall must be slotted and that it then has to follow the rotation.

To facilitate the incoming of air through the spokes 14 these can be formed as propeller blades.

Through the present invention one attains as said above a better ventilation of cars, houses, etc, which is independent of driving velocity, the direction and strength of the wind. The devices in which the fan according to the invention are used will also be simpler or more compact than earlier comparable devices. This depends primarily on that valves which are difficult to locate and which are space demanding can be excluded. The constructions will also be straighter and simpler.

The fan according to the invention can also completely close the medium stream from one axial end by displacing the partition wall completely to one or the other end. In such a way one can use what medium stream one wishes.

The invention is not limited to the embodiment shown but can be varied in different ways within the scope of the claims. Thus it is not necessary that only gaseous media are pumped through the fan according to the invention also liquids can advantageously be pumped and mixed by means of this.

I claim:

1. A ventilation system for a car, comprising: an outside air channel, an interior air channel, a radial fan having a suction side and an exhaust side, said fan being situated at a junction between said outside air and interior air channels, said channels being axially connected from different directions to said suction side of the fan, said radial fan including a plurality of elongated blades, an unrestricted cavity surrounded by said blades, a partition wall movable within said unrestricted cavity, so that said outside air and interior air channels being situated at different sides of said partition wall, whereby proportion between air delivered from said outside air channel and air delivered from said interior air channel to said exhaust side is adjustable by movement of said partition wall within said unrestricted cavity.

2. The ventilation system of claim 1, further comprising a rotatable shaft assembly extending within said unrestricted cavity, said partition wall is slidably mounted on said rotatable shaft assembly.

3. The ventilation system of claim 2, wherein said rotatable shaft assembly further comprises an elongated substantially hollow body having an outer wall, an axial slot formed within said outer wall, a shaft rotatably mounted within said hollow body, said partition wall having a protrusion passing through said axial slot for engagement with said shaft.

4. The ventilation system of claim 3, wherein meshing threads are provided on said shaft and said projection, so that said partition wall being moved along said body upon rotation of said shaft while the projection threadably engages said shaft.

5. A ventilation system for a car, comprising;

an outside medium channel, an interior medium channel, a radial fan having a suction side and an exhaust side, said outside medium and interior medium channels being axially connected to said suction side of the fan from opposite directions, said radial fan comprising a plurality of elongated blades, an unrestricted cavity surrounded by said blades, an adjusting means for adjusting a volume of a medium delivered from said outside medium channel and said interior medium channel to said exhaust side, said adjusting means being movable along said longitudinal axis within said unrestricted cavity, so that said outside medium channel and said interior medium channel being situated at different sides of said partition wall.

6. The ventilation system of claim 3, wherein said unrestricted cavity extends along said longitudinal axis of the radial fan, said medium is air and an outside medium channel and said interior medium channel deliver said air to said suction side of the radial fan.

7. The ventilation system of claim 6, wherein said adjusting means is a partition wall movable within said unrestricted cavity along said longitudinal axis.

8. The ventilation system of claim 7, further comprising a rotatable shaft assembly extending within said unrestricted cavity, said partition wall is slidably mounted on said rotatable shaft assembly.

9. The ventilation system of claim 8, wherein said rotatable shaft assembly further comprises an elongated substantially hollow body having an outer wall, an axial slot formed within said outer wall, a shaft rotatably mounted within said hollow body, said partition wall having a protrusion passing through said axial slot for engagement with said shaft.

10. The ventilation system of claim 9, wherein meshing threads are provided on said shaft and said projection, so that said partition wall being moved along said body upon rotation of said shaft while the projection threadably engages said shaft.

11. A ventilation system of claim 1, wherein a volume of air delivered from said outside air channel and said interior air channel to said exhaust side is adjustable by movement of said partition wall within said unrestricted cavity.

* * * * *

UNITED STATES PATENT AND TRADEMARK OFFICE

CERTIFICATE OF CORRECTION

PATENT NO. : 5,478,275

DATED : December 26, 1995

INVENTOR(S) : Lars Malm

It is certified that error appears in the above-identified patent and that said Letters Patent is hereby corrected as shown below:

Column 4, line 49, delete "3" and insert therefor --5--.

Signed and Sealed this

Twelfth Day of March, 1996

Bruce Lehman

*Attest:*

BRUCE LEHMAN

*Attesting Officer*

*Commissioner of Patents and Trademarks*